US011344100B1

(12) United States Patent
Shugar

(10) Patent No.: US 11,344,100 B1
(45) Date of Patent: May 31, 2022

(54) LEAK-RESISTANT LOW-FRICTION COSMETIC CONTAINER AND APPLICATOR

(71) Applicant: Bolero Home Decor, Inc., Sarasota, FL (US)

(72) Inventor: Ronald Shugar, Longboat Key, FL (US)

(73) Assignee: Bolero Home Decor, Inc., Sarasota, FL (US)

( * ) Notice: Subject to any disclaimer, the term of this patent is extended or adjusted under 35 U.S.C. 154(b) by 0 days.

(21) Appl. No.: 17/091,197

(22) Filed: Nov. 6, 2020

(51) Int. Cl.
*A45D 40/06* (2006.01)
*A45D 40/02* (2006.01)
*A45D 40/20* (2006.01)

(52) U.S. Cl.
CPC ..... *A45D 40/065* (2013.01); *A45D 40/02* (2013.01); *A45D 2040/207* (2013.01)

(58) Field of Classification Search
CPC ..... A45D 40/02; A45D 2040/207; B65D 83/0005
USPC ..... 401/55, 176
See application file for complete search history.

(56) References Cited

U.S. PATENT DOCUMENTS 1,616,262 A * 2/1927 Knaust ..... B65D 83/0005 206/525
1,780,508 A * 11/1930 Schulse ..... B65D 83/0005 401/82
2,026,266 A 12/1935 Booty
2,720,966 A 10/1955 Davis
3,144,189 A * 8/1964 Bartz ..... B65D 5/14 229/122.31
3,256,980 A 6/1966 Bau
3,431,909 A 3/1969 Krusko
3,810,700 A 5/1974 Bryan
4,621,935 A * 11/1986 Sussman ..... A45D 40/02 220/200
5,760,118 A * 6/1998 Sinclair ..... A61L 15/26 524/306

(Continued)

FOREIGN PATENT DOCUMENTS

EP 3868682 A1 * 8/2021 ..... A47G 19/265
GB 2584870 A * 12/2020 ..... A45D 40/02

OTHER PUBLICATIONS

Google, "Push Tube Glossy", downloaded from https://images.app.goo.gl/K3w8WFTu84GPLqyL9 on Feb. 2, 2021, pp. 1-2.

(Continued)

*Primary Examiner* — David P Angwin
*Assistant Examiner* — Bradley S Oliver
(74) *Attorney, Agent, or Firm* — The Concept Law Group, PA; Scott D. Smiley; Scott M. Garrett

(57) ABSTRACT

A material applicator for cosmetic substances is provided. The material applicator includes a leak-resistant and low-friction container including a bottom portion functioning as a tube, an affixable top portion, and a plunger member configured to internally dispense the cosmetic substance from the material applicator. The plunger member further including a fluid-resistant friction-reducing coating made of polylactic acid (PLA) and being configured to slidably and frictionally traverse an interior chamber of the material applicator while preventing leaking of the cosmetic substance from the material applicator.

20 Claims, 6 Drawing Sheets

(56) References Cited

U.S. PATENT DOCUMENTS

| | | | | |
|---|---|---|---|---|
| 5,944,434 | A * | 8/1999 | Schlatter | A45D 40/02 401/82 |
| 2004/0037858 | A1 | 2/2004 | Mammone | |
| 2005/0087570 | A1* | 4/2005 | Jackman | B65D 83/0005 222/541.4 |
| 2010/0150972 | A1* | 6/2010 | West | B65D 65/466 424/401 |
| 2014/0021651 | A1 | 1/2014 | Martins et al. | |
| 2017/0007003 | A1 | 1/2017 | Paquet | |
| 2021/0269191 | A1* | 9/2021 | Peterson | B65D 83/0005 |

OTHER PUBLICATIONS

Major Custom Industry Co., Ltd., "Custom Printing Paper Deodorant Tube Containers (RB56)", downloaded from https://www.mcpackagings.com/product-detail/paper-deodorant-tube-container/, on Feb. 2, 2021, pages, pp. 1-4.

Wilpackaging, Co., Ltd.,"Paper Tube For Lip Balm Push Up Paper Tube With Wax Paper", downloaded from http://wilpackaging.com/e_productshow/?13-Paper-Tube-For-Lip-Balm-Push-Up-Paper-Tube-With-Wax-Paper-13.html, on Feb. 2, 2021, pp. 1-8.

Greenway Containers, ".25 ounce / 7 g Glossy White Paper Lip Balm Tubes", downloaded from https://greenwaycontainers.com/products/25-ounce-7-g-white-paper-lip-balm-tubes, on Feb. 2, 2021, pp. 1-3.

International Search Report and Written Opinion from the International Searching Authority for International Application No. PCT/US2021/057928, Authorized Officer Harry Kim, dated Jan. 31, 2022, pp. 1-9.

* cited by examiner

LEAK-RESISTANT LOW-FRICTION COSMETIC CONTAINER AND APPLICATOR

FIELD OF THE INVENTION

The present invention relates generally to a cosmetic product container, and, more particularly, relates to a leak-resistant low-friction cosmetic product container and applicator.

BACKGROUND OF THE INVENTION

Cosmetic products, such as makeup, moisturizers, deodorant, and other skincare-related products are ubiquitous. Particularly, the aforementioned products have become more common in everyday use due to not only their portability, but also the ease of use associated with the applicators holding the substance to be applied to the user. For example, deodorant containers are traditionally composed of plastic and ordinarily include a push-up or twist-up mechanism configured to allow the cosmetic substance in the container to incrementally elevate from the container until the substance is depleted.

However, a recent trend associated with this industry is that cosmetic product providers have engaged in practicing environmental sustainability. Reducing the amount of plastic packaging for cosmetic products by using biodegradable containers allows these cosmetic product providers to reduce their carbon footprint on the environment. A new environment-friendly alternative is the use of biodegradable paper products that are configured to be compostable once the substance contained in the product is depleted. Nonetheless, this alternative has a major drawback being that paper-based containers containing fluid-like or gelatinous consistencies tend to saturate the paper-based containers resulting in the functionality of the containers being impacted significantly. For example, paper-based containers containing substances having viscous consistency, such as a balm, suffer from issues such as the substance eventually leaking from the container due to oversaturation of the paper foundation resulting in a reduction of the sturdy infrastructure. Tight tolerances between the mechanical components, geared toward preventing leakage pathways, may also damage the dispensing attributes of the paper-based container by adding unwanted friction to the mechanisms used to dispense the cosmetic substance out of the container.

Therefore, a need exists to overcome the problems with the prior art as discussed above. In particular, what is needed is a biodegradable and compostable applicator configured to dispense a cosmetic substance without being susceptible to the aforementioned issues.

SUMMARY OF THE INVENTION

The invention provides a leak-resistant low-friction cosmetic container and applicator that overcomes the hereinafore-mentioned disadvantages of heretofore-known cosmetic substance containers. More particularly, the invention provides a material applicator configured to retain and dispense on demand a material having a viscous consistency. The applicator is configured to dispense the material via a tube comprising an interior chamber retaining the material and a plunger member configured to be in contact with the material in the interior chamber, wherein the plunger member has an outer surface shaped and sized to slidably and frictionally engage with the interior chamber of the tube. The plunger member further includes a paper layer configured to reduce friction between the outer surface of the plunger member and the interior chamber of the tube. The material applicator is further configured to dispense the material having a viscous consistency in a manner in which the infrastructure of the material applicator is not oversaturated, preventing the material from leaking from the material applicator.

It is therefore a general objective of the present invention to utilize components such as the tube, the plunger member, the paper layer, and other components, such as a gap between the outer surface of the plunger member and the interior chamber of the tube in order to prevent material having a viscous consistency from leaking from a first side of the plunger member to a second side of the plunger member at room temperature and ultimately leaking outside of the material applicator.

In one embodiment, the material applicator includes a tube comprising a length and an interior chamber; a plunger member comprising an outer surface that is shaped and sized to slidably and frictionally engage with the interior chamber of the tube; a height that is between one fourth and one half the length of the tube; and a paper layer on an outer surface of the plunger member configured to reduce friction between the outer surface of the plunger member and the interior chamber of the tube.

In another embodiment, the plunger member is configured to elevate the material through the interior chamber of the tube via an upward force applied to the second side of the plunger member.

In yet one more embodiment, the material applicator further includes a frictional coefficient between the interior chamber of the tube and the outer surface of the tube, wherein the frictional coefficient is less than or equal to 2.

In an additional embodiment, the material applicator further includes an open position and a closed position based on a detachable cap, wherein the cap is directly affixed to the tube enclosing the interior chamber in the closed position and the cap is detached from the tube exposing the interior chamber in the open position.

Although the invention is illustrated and described herein as embodied in a cosmetic material applicator, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the installation tool. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
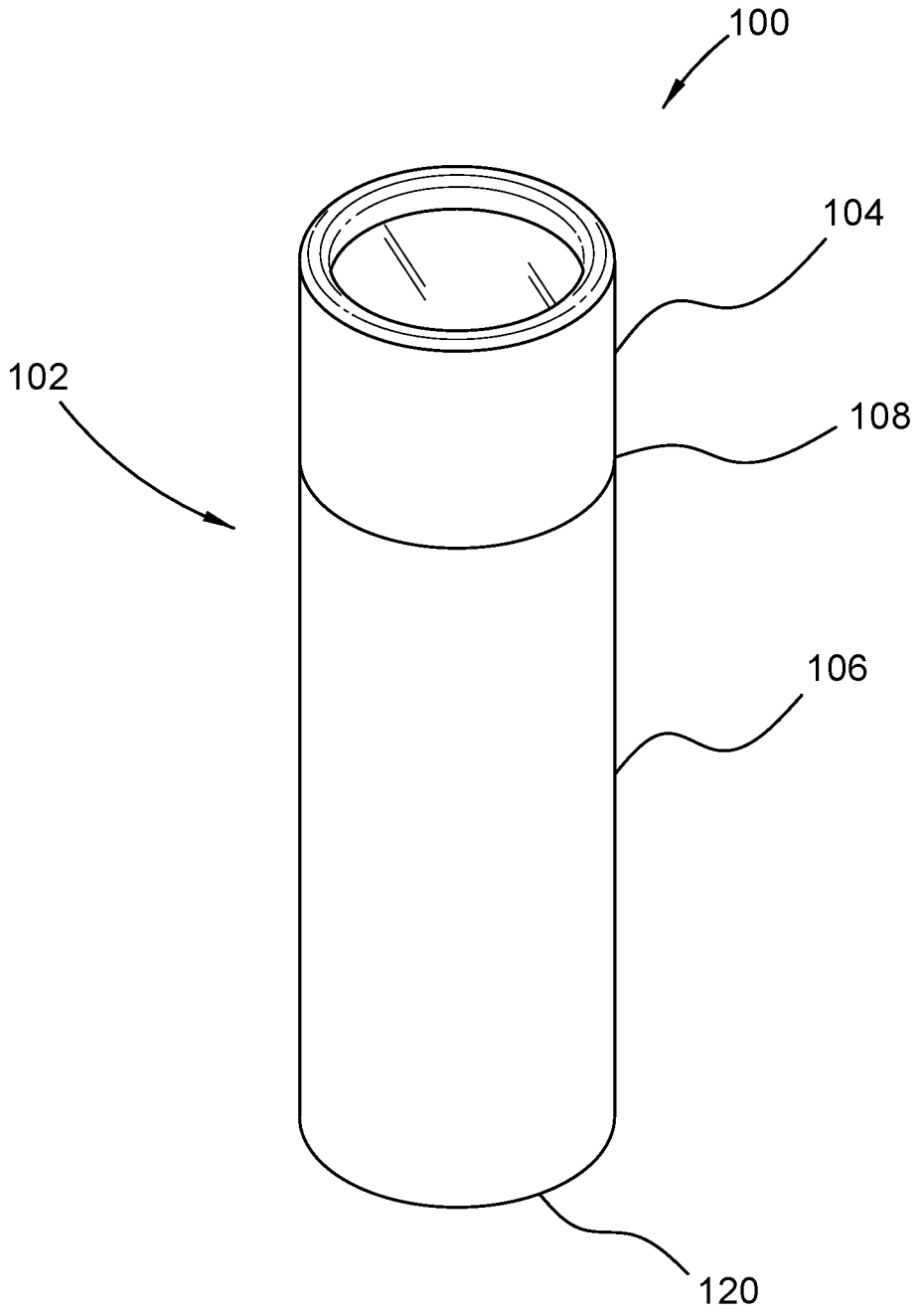
FIG. 1 is a perspective downward-looking top-side view of a material applicator in a closed position, according to an example embodiment.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Referring now to FIG. 1, a material applicator 100 is shown in a perspective view, according to an example embodiment. In one embodiment, material applicator 100 includes a tube 102, wherein tube 102 includes a top portion 104 and bottom portion 106. Top portion 104 and bottom portion 106 are configured to be detachably coupled wherein top portion 104 is designed to function as a cap and bottom portion 106 includes a groove 108 which engages one or more protrusions extending from bottom portion 106 allowing top portion 104 to be securely affixed to bottom portion 106 in an interlocking and/or integrating manner. It is to be understood that material applicator 100 is configured in some embodiments to support a screw cap structure in which top portion 104 may function as a twistable cap configured to interlock with a plurality of twist cap spiraling receivers allocated along grove 108 to support an interlocking and sealed fit on bottom portion 106. In one embodiment, tube 102 further includes a bottommost surface 120 wherein bottommost surface 120 may be a planar surface configured to serve as a foundational support allowing tube 102 to stand upright alone or bottommost surface 120 may be ribbed and include an aperture wherein the aperture is encircled by the ribbing of bottommost surface 120. Material applicator 100 may be formed from a single piece or from several individual pieces joined or coupled together. It is to be understood that material applicator 100 may be composed of carbon steel, stainless steel, aluminum, titanium, composites, ceramics, polymeric materials such as polycarbonates, such as acrylonitrile butadiene styrene (ABS plastic), Lexan™, Makrolon™, or any other applicable material. In one embodiment, material applicator 100 may be molded from a biodegradable plastic resin such as corn-derived PLA or similar biodegradable resin. However, in a preferred embodiment, material applicator is composed of polylactic acid (PLA) paper that will degrade when exposed to biodegrading influences configured to decompose the PLA paper into its natural components and be compostable. It is to be understood that material applicator 100 and all of its components may be manufactured from a variety of different processes including an extrusion process, a mold, welding, shearing, punching welding, folding etc.

Figure 2:
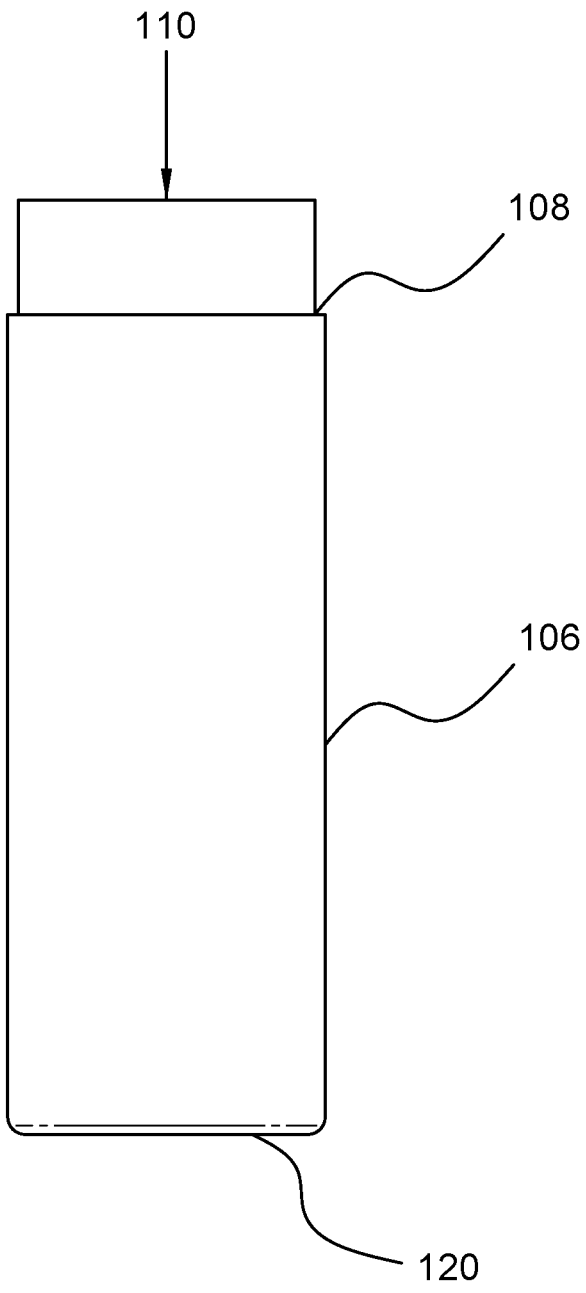
FIG. 2 is an elevational side view of the material applicator of FIG. 1 in an open position, according to an example embodiment.

Referring now to FIG. 2, material applicator 100 is illustrated in an open position (top portion 104 is not affixed), wherein bottom portion 106 is depicted in an elevational side view. Bottom portion 106 includes an interior chamber 110 shaped and sized to retain a material having a viscous consistency wherein an upmost portion of the material is exposed due to protrusion from interior chamber 110. In one embodiment, material applicator 100 includes a closed position, as illustrated in FIG. 1, wherein top portion 104 is affixed to bottom portion 106 resulting in top portion 104 enclosing interior chamber 110, and the open position, as illustrated in FIGS. 2-6, wherein top portion 104 is detached from bottom portion 106 allowing a top surface of the material included in interior chamber 110 to be exposed. In a preferred embodiment, material retained in interior chamber 110 is configured to fill up interior chamber 110 in a manner wherein the material extends vertically beyond groove 108 allowing the upmost portion of the material to protrude from the upper area of bottom portion 106 and be applied to the user. In one embodiment, top portion 104 includes a hollowed interior chamber shaped and sized to fully enclose the upmost portion of material protruding from interior chamber 110. Various shapes, sizes, and dimensions associated with top portion 104 are within the scope and spirit of the disclosure. For example, top portion 104 may be a twist-based top configured to retract a covering (not shown) concealing interior chamber 110, wherein upon retraction of the covering via a twisting motion applied to top portion 104 and/or bottom portion 106 the upmost portion of the material is exposed.

It is to be understood that the material may be any applicable cosmetic substance, but in a preferred embodiment, the material includes a viscous consistency configured to be applied to the user until the material is depleted. The material comprising a viscous consistency may be an oil-based substance, balm, lotion, salve, sunscreen, repellant, moisturizer, deodorant, lipstick, or any other applicable substance configured to be applied to a user cosmetically. In one embodiment, the material included in interior chamber 110 is configured to maintain a firm or solid-like state confined by the interior walls of tube 102 which allows the material to firmly protrude out of interior chamber 110. However, a well-known issue associated with retainers including materials having viscous consistencies is the inability for the retainer to account for the material at room temperature or higher due to the viscosity impacting the amount of friction utilized when distributing retained material. The following components of the disclosure seek to address the aforementioned issue by integrating layered mechanisms configured to overcome not only frictional issues for material applicators but also issues relating to undesired seeping and oozing of said viscous materials.

Figure 3:
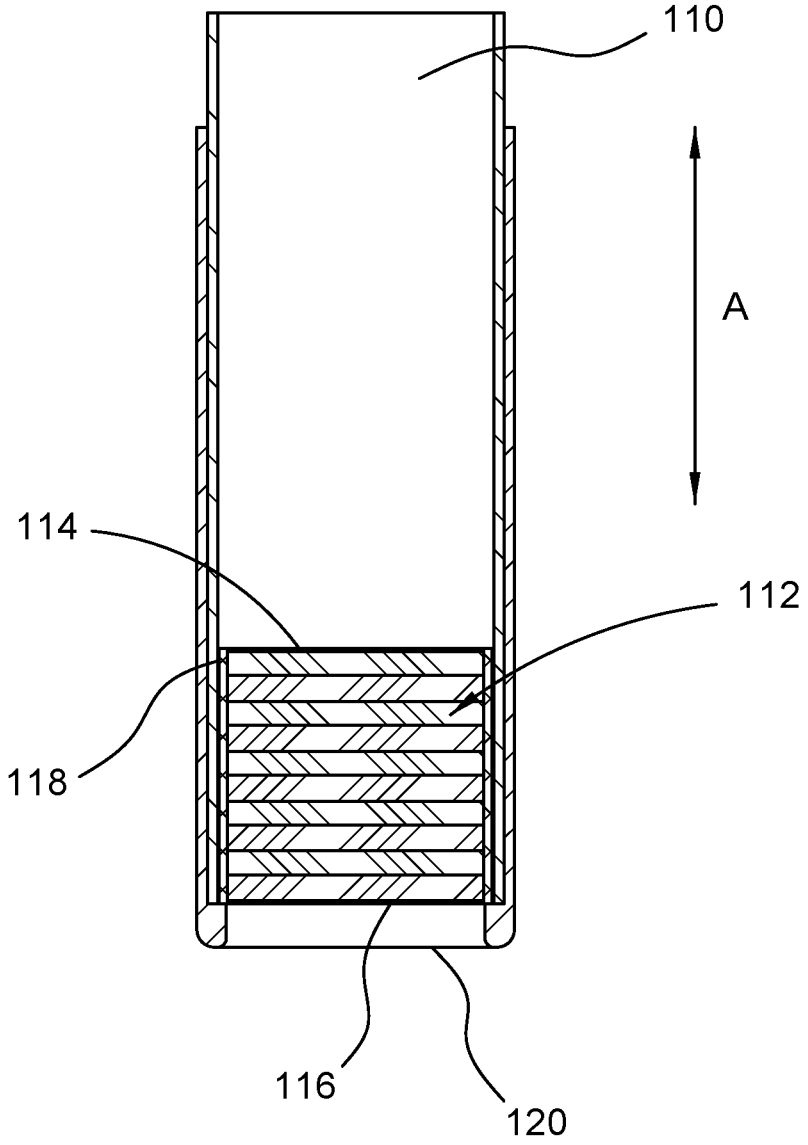
FIG. 3 is an elevational side cross-sectional view of the material applicator of FIG. 1 in the open position, according to an example embodiment.

Referring now to FIG. 3, tube 102 further includes a plunger member 112 located within the interior of tube 102 configured to traverse interior chamber 110. The plunger member 112 includes a top surface 114 and a bottom surface 116 wherein plunger member 112 is constructed in a manner in which layers of material are integrated together in order to reduce the amount of friction associated with plunger member 112 traversing interior chamber 110. In one embodiment, plunger member 112 includes a circular or disk-like structure in which the exterior surface of plunger member 112 extends vertically between top surface 114 and bottom surface 116 in a manner in which plunger member 112 is held in frictional engagement against and/or within the interior walls of tube 102 that help compose interior chamber 110. It is to be understood that plunger member 112 may be manifested in various shapes, sizes, and dimensions as long as the aforementioned allows plunger member 112 to slidably and frictionally engage with the interior walls of tube 102 and interior chamber 110 from at least bottommost surface 120 to groove 108. In a preferred embodiment, the material having viscous consistency configured to be retained in interior chamber 110 is positioned directly above plunger member 112 and, in particular, top surface 114 wherein the frictional engagement between plunger member 112 and the interior walls of tube 102 is strong enough to support plunger member 112 along with the weight of the material included within interior chamber 110 resting atop top surface 114.

In one embodiment, plunger member 112 includes a paper layer 118 configured to be allocated throughout plunger member 112 wherein plunger member 112 is held in place within the interior walls of tube 102 and interior chamber 110 by paper layer 118 via a frictional force strong enough to support immobility of plunger member 112 without an upward or downward force applied to plunger member 112 by a user. In one embodiment, paper layer 118 makes direct contact with the interior walls of tube 102 where the interior walls may be coated or lined with a substance that provides a high coefficient of friction; however, it is to be understood that paper layer 118 may function as the coating or lining configured to provide a high enough coefficient of friction to not only support tight and unmovable retention of plunger member 112 within interior chamber 110 unless a user force is applied, but also the configuration and high coefficient of friction is maintained regardless of exposure to the viscous consistency of the material retained within interior chamber 110. In other words, paper layer 118 is configured so exposure to liquid or viscous materials does not impact the frictional engagement with plunger member 112 against the interior walls of tube 102 and within interior chamber 110.

In one embodiment, plunger member 112 is configured to traverse interior chamber 110 based on an upward force applied by a user to bottom surface 116 through the aperture of bottommost surface 120 (described in greater detail in reference to FIG. 5) slidably and frictionally enabling the material retained within interior chamber 110 to incrementally protrude out of interior chamber 110 via the upward force resulting in the upmost portion of the material to be applied to the user; however, simultaneously paper layer 118 is in constant and continuous contact with the material included within interior chamber 110 and is further shaped and designed to ensure that no remnants of the material is overpassed by plunger member 112 as plunger member 112 traverses up interior chamber 110 due to the frictional engagement between paper layer 118 and the interior walls of tube 102. It is to be understood that the coefficient of friction provided by paper layer 118 is high enough to secure contact between plunger member 112 and interior walls of tube 102; while paper layer 118, in combination with plunger member 112, reinforce-ably upholds the material included within interior chamber 110.

Plunger member 112 is configured to support bi-directional movement (as illustrated in FIG. 3 by line A), wherein as the material within interior chamber 110 progressively depletes from the upmost portion via application to the user, the user may incrementally apply the upward force to bottom surface 116 allowing the material within interior chamber 110 to continue to protrude from interior chamber 110 as plunger member 112 rises within interior chamber 110. If the user decides that too much of the material within interior chamber 110 is exposed (i.e., the upmost portion of the material is protruding too far outside of interior chamber 110), then the user may apply a downward force on the upmost portion of the material allowing plunger member 112 to traverse down interior chamber 110 in the direction of bottommost surface 120.

Figure 4:
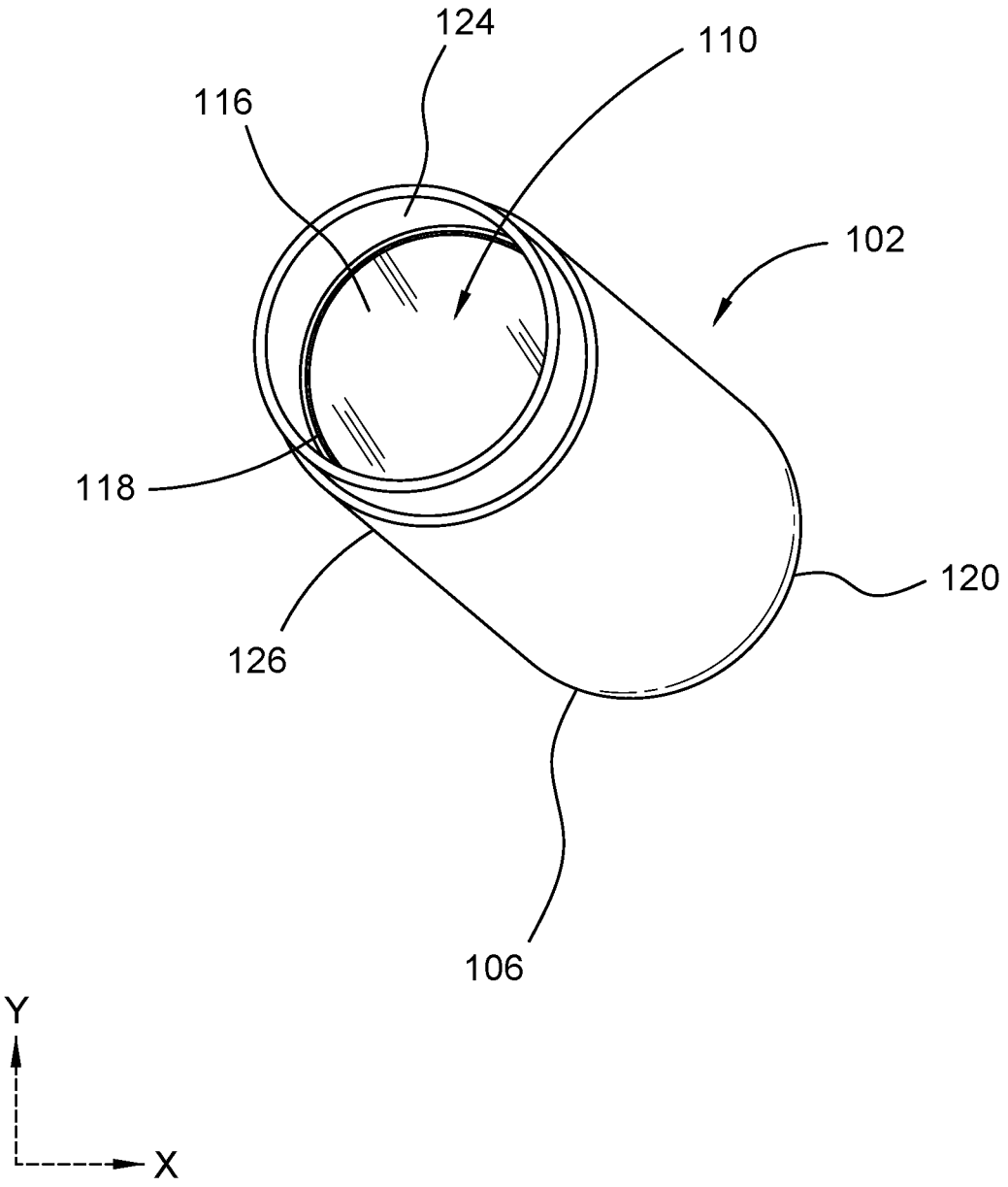
FIG. 4 is a perspective downward-looking view of the bottom-portion of the material applicator of FIG. 1, according to an example embodiment.

Referring now to FIG. 4, a perspective top view of bottom portion 106 in the open position is depicted, according to an exemplary embodiment. In one embodiment, tube 102 may include a plurality of layers of PLA paper in order to generate a sturdy and rigid foundational structure configured to be impervious to saturation of fluid-like and/or viscous materials. The plurality of layers includes an innermost layer 124 in direct contact with an outermost layer 126 wherein outermost layer 126 is configured to function as the exterior surface of tube 102 and the innermost layer 124 makes up the walls of tube 102 cooperating to define interior chamber 110. It is to be understood that various shapes, sizes, and dimensions of the plurality of layers are within the scope and spirit of the disclosure, and the layers may be a liquid impervious panel supporting a plurality of angles, curves, and lengths subject to the configuration of material applicator 100. The coefficient of friction associated with paper layer 118 and its direct contact with innermost layer 124 in the direction of a y-axis allows plunger member 112 to be held in place by the frictional force while simultaneously ensuring that all remnants of the material included within interior chamber 110, including portions of the material sticking to innermost layer 124, are collected and carried up interior chamber 110 due to both the upward force applied to bottom surface 116 and the direct contact of paper layer 118 with the material. To ensure that the frictional force is strong enough to securely hold plunger member 112 not only is innermost layer 124 configured to be coated or lined with substance configured to provide a higher coefficient of friction, but also paper layer 118, in particular the portion of paper layer 118 allocated at top surface 114, is designed to include an expanded surface area configured to ensure unpassable contact with the material in interior chamber 110 in addition to a high coefficient of friction by enabling retentive contact between innermost layer 124 and paper layer 118. It is to be understood that the coefficient of friction (COF) is a dimensionless scalar value that describes the ratio of the force of friction between two bodies and the force pressing them together. In one embodiment, the COF between the walls of interior chamber 110 and plunger member 112 ranges from near zero to two or any applicable value derived from the coefficient of friction equation $f=\mu N$, wherein f is the friction force, N is the normal force, and n is the coefficient of friction.

In one embodiment, the height of plunger member 112 (the distance between top surface 114 and bottom surface 116) may range from $1/4^{th}$ of the height of tube 102 to ½ of the height of tube 102. It is to be understood that the height of tube 102 is the distance between bottommost surface 120 and the topmost portion of at least one of innermost layer 124 and/or bottom portion 106. In a preferred embodiment, plunger member 112 is approximately $1/3^{rd}$ the length of at least one of tube 102, innermost layer 124, and/or outermost layer 126. The aforementioned embodiment allows plunger member 112 to have the range of movement from directly above bottommost surface 120 up throughout interior chamber 110 up to the highest point of the protrusion or innermost layer 124.

Figure 5:
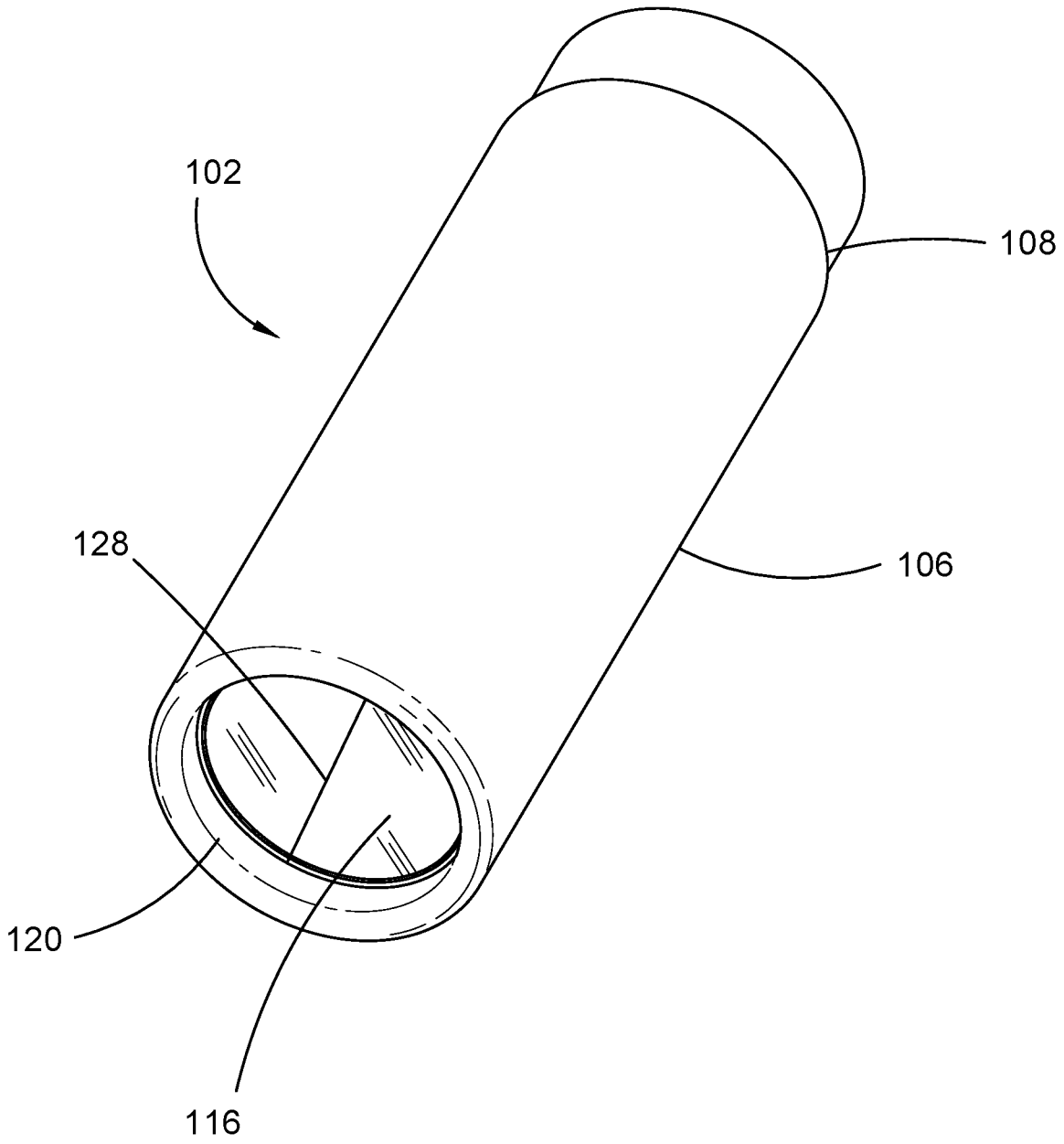
FIG. 5 is a perspective bottom-side view of the material applicator of FIG. 1, according to an example embodiment.
Figure 6:
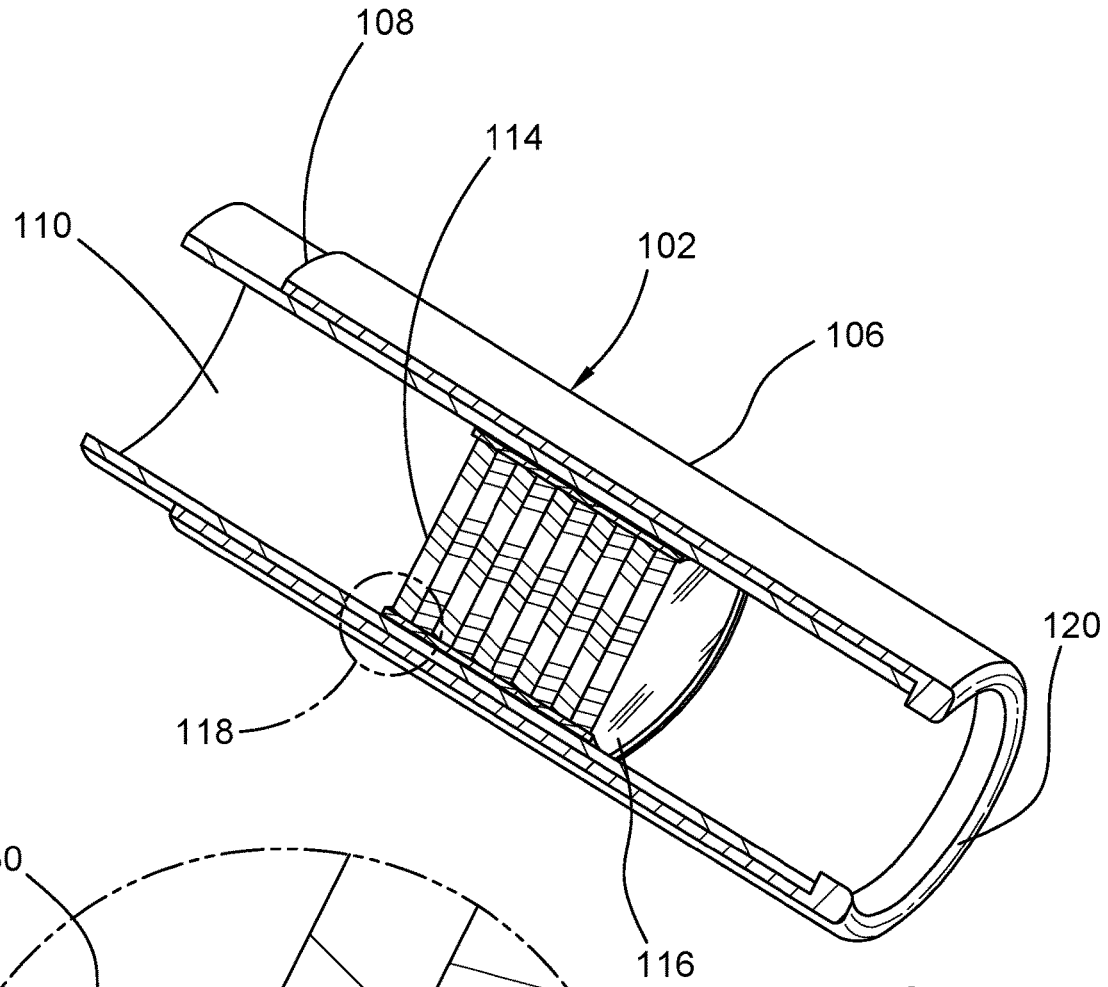
FIG. 6 is a second perspective cross-sectional view of the material applicator of FIG. 1 in the open position, according to an example embodiment.

Referring now to FIG. 5, bottommost surface 120 further includes an aperture 128 configured to serve as a portal for a user to apply the upward force to bottom surface 116 configured to enable plunger member 112 to traverse up interior chamber 110. In one embodiment, aperture 128 may be shaped and sized to fit at least a finger and/or digit allowing the upward force to be applied to bottom surface 116 to traverse up interior chamber 110. In one embodiment, bottom portion 106 further includes a lip allocated at bottommost surface 120 in a ribbed configuration respective to aperture 128. Paper layer 118 is allocated along bottom surface 116 providing a high coefficient of friction and further supporting the frictional engagement between plunger member 112 and innermost layer 124. It is to be understood that the configuration of bottom surface 116 and bottommost surface 120, but more importantly bottom surface 116, is designed and intended to serve as the last line of defense for preventing the material included within interior chamber 110 from seeping and/or oozing from tube 102. For example, due to the expanded surface area of top surface 114, material retained within interior chamber 110 is continuously in contact with top surface 114 so that paper layer 118 is actively preventing seeping or oozing of the material along the surface of plunger member 112 while bottom surface 116 is utilizing paper layer 118 to ensure that the potential minimal amounts of the material within interior chamber 110 that manages to come into contact with a surface of plunger member 112 between top surface 114 and bottom surface 116 ultimately ends up in contact with paper layer 118 allocated at bottom surface 116 preventing seeping or oozing of the material through bottommost surface 120 and/or aperture 128.

It is to be understood that paper layer 118 is configured to serve as the exterior of plunger member 112 and is designed to reduce the amount of friction between the exterior of plunger member 112 and innermost layer 124 once paper layer 118 becomes saturated with the material within interior chamber 110. At the same time, the frictional engagement between the paper layer 118 and innermost layer 124 prevents fluids and other applicable cosmetic substances associated with the material retained within interior chamber 110 from escaping tube 102. In one embodiment, paper layer 118 is configured to be impervious to liquids in order to ensure that the material within interior chamber 110 closest to top surface 114 does not disrupt the sliding engagement between the exterior of plunger member 112 and innermost layer 124. The term "paper layer," as used herein, is not limited to only a traditional paper material. The term is intended to indicate a thin layer of material that can wrap around and adhere to an object so as to alter or improved the COF properties of the object being covered.

Figure 7:
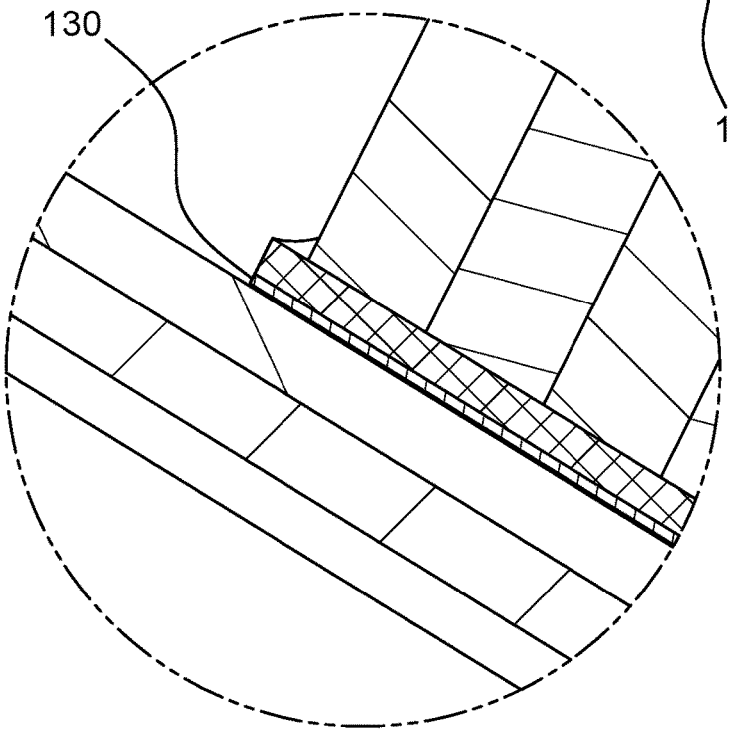
FIG. 7 is an exploded view of a top surface of a plunger member of material applicator of FIG. 1, according to an example embodiment.

Referring now to FIG. 7, an enlarged view of top surface 114 and paper layer 118, according to an exemplary embodiment. In one embodiment, plunger member 112 further includes a gap 130 configured to be associated with the exterior of plunger member 112 and innermost layer 124, wherein gap 130 is further configured to prevent any possible leaking paths of the material within interior chamber 110 from tube 102. Gap 130 is significantly small in size and designed to prevent exuding of the material retained within interior chamber 110 including a viscous consistency at room temperature from escaping interior chamber 110, plunger member 112, paper layer 118, and bottommost surface 120. It is to be understood that due to the viscous consistency of the material retained within interior chamber 110 and its ability to traverse innermost layer 124 (stick to the walls thereof), paper layer 118 and gap 130 cooperatively ensure that plunger member 112 is in contact with the material allowing paper layer 118 to utilize its liquid impervious functionality to apply constant frictional contact to both the material and innermost layer 124. In one embodiment, as plunger member 112 is traversing interior chamber 110, the configuration of tube 102 is arranged so the material retained in interior chamber 110 is not absorbed by any of the walls of interior chamber 110, plunger member 112, or paper layer 118, but due to the upright structure of tube 102 the material is configured to be moved vertically in an airtight manner and does not seep past plunger member 112 due to the layered structure of paper layer 118. In other words, due to plunger member 112 being in direct contact with the walls that cooperate to define interior chamber 110 in a slidable, frictional, and airtight manner the exterior of plunger member 112, via paper layer 118, generates the frictional coefficient associated with the walls of interior chamber 110; thus requiring the force needing to be applied by the user to bottom surface 116 in order for plunger member 112 to effectively traverse interior chamber 110.

A material applicator has been disclosed that is configured to retain cosmetic substances within a biodegradable and compostable tube that dispenses materials with viscous consistencies without falling subject to saturation of the foundational structure of the material applicator along with leaking of the cosmetic substance included therein from the material applicator. The material applicator utilizes a novel and unconventional layer composed of polylactic acid (PLA) paper allocated on a plunger mechanism configured to efficiently dispense cosmetic substances from the material applicator without being susceptible to saturation and while simultaneously preventing leakage of the cosmetic substance.

The claims appended hereto are meant to cover all modifications and changes within the scope and spirit of the present invention.

What is claimed is:

1. A material applicator comprising:

a tube having a length and an interior chamber having an interior wall; and a plunger member having:

an outer surface that is shaped and sized with the interior chamber of the tube;

a height that is between one fourth and one half the length of the tube; and a paper layer adhered on the outer surface of the plunger member, the paper layer configured to provide friction with the interior wall sufficient to hold the plunger member immobile in the tube until a user force is applied to the plunger member.

2. The material applicator of claim 1, the applicator further comprising:

a gap between the outer surface of the plunger member and the interior chamber of the tube, wherein the gap is sufficiently small and configured to prevent a material comprising a viscous consistency from passing from a first side of the plunger member to a second side of the plunger member at room temperature.

3. The material applicator of claim 2, wherein the plunger member is configured to elevate the material through the interior chamber of the tube via an upward force applied to the second side of the plunger member.

4. The material applicator of claim 2, wherein the material applicator is further configured to receive a downward force applied to a topmost surface of the material allowing the plunger member to traverse down the interior chamber of the tube.

5. The material applicator of claim 1, wherein:

a frictional coefficient between the interior chamber of the tube and the outer surface of the plunger member is less than 2.

6. The material applicator of claim 1, wherein the paper layer is composed of polylactic acid (PLA) paper.

7. The material applicator of claim 1, wherein the height of the plunger member is approximately ⅓ the length of the tube.

8. The material applicator of claim 1, wherein the material applicator is biodegradable and compostable.

9. The material applicator of claim 1, further comprising a cap configured to be affixed to the tube and enclose the interior chamber.

10. The material applicator of claim 9, further comprising a closed position wherein the cap is directly affixed to the tube enclosing the interior chamber and an open position wherein the cap is detached from the tube exposing the interior chamber.

11. A method of manufacturing material applicator, the method comprising:

providing a tube having a length and an interior chamber;

providing a plunger member having:

an outer surface that is shaped and sized to slidably and frictionally engage with the interior chamber of the tube; and a height that is between one fourth and one half the length of the tube; and attaching a paper layer to the outer surface of the plunger member, the paper layer configured to reduce friction between the outer surface of the plunger member and at least a wall associated with the interior chamber of the tube.

12. The method of claim 11, further comprising:

providing a gap between the outer surface of the plunger member and the interior chamber of the tube, wherein the gap is sufficiently small and configured to prevent a material comprising a viscous consistency from passing from a first side of the plunger member to a second side of the plunger member at room temperature.

13. The method of claim 12, wherein:

the plunger member is configured to elevate the material through the interior chamber of the tube via an upward force applied to the second side of the plunger member.

14. The method of claim 12, further comprising:

filling a portion of the tube with at least one of a balm or a salve.

15. The method of claim 11, wherein:

a frictional coefficient between the interior chamber of the tube and the outer surface of the plunger member is less than 2.

16. The method of claim 11, wherein:

the paper layer is composed of polylactic acid (PLA) paper.

17. The method of claim 11, wherein:

the height of the plunger member is approximately ⅓ the length of the tube.

18. The method of claim 12, wherein:

the material applicator is further configured to receive a downward force applied to a topmost surface of the material allowing the plunger member to traverse down the interior chamber of the tube.

19. The method of claim 11, further comprising:

providing a cap configured to be affixed to the tube and to enclose the interior chamber.

20. The method of claim 19, wherein:

the material applicator has a closed position wherein the cap is directly affixed to the tube enclosing the interior space and an open position wherein the cap is detached from the tube exposing the interior chamber.

* * * * *